US007775334B2

(12) United States Patent
Drew et al.

(10) Patent No.: US 7,775,334 B2
(45) Date of Patent: Aug. 17, 2010

(54) ROTATABLE HANDLE AND METHOD FOR ATTACHING A FIRST CARRY BAG SYSTEM TO A SECOND CARRY BAG SYSTEM, AND CARRY BAG HAVING SAME

(75) Inventors: Jason Drew, Shorewood, MN (US); Richard J. Krulik, Dix Hills, NY (US); Georgene Rada, Northport, NY (US)

(73) Assignee: Briggs & Riley Travelware LLC, Hauppauge, NY (US)

( * ) Notice: Subject to any disclaimer, the term of this patent is extended or adjusted under 35 U.S.C. 154(b) by 251 days.

(21) Appl. No.: 11/435,468

(22) Filed: May 16, 2006

(65) Prior Publication Data

US 2006/0260893 A1 Nov. 23, 2006

Related U.S. Application Data

(60) Provisional application No. 60/682,222, filed on May 17, 2005.

(51) Int. Cl.
*A45C 13/26* (2006.01)
*A45C 13/28* (2006.01)
*A45C 13/30* (2006.01)

(52) U.S. Cl. ..... 190/108; 190/39; 190/115; 280/47.26

(58) Field of Classification Search ..... 190/37, 190/39, 102, 108, 115, 38, 15.1, 18 A; 150/111; 280/37, 47.17, 47.131, 47.26
See application file for complete search history.

(56) References Cited

U.S. PATENT DOCUMENTS 652,473 A * 6/1900 Cole ..... 190/27

(Continued)

*Primary Examiner*—Sue A Weaver
(74) *Attorney, Agent, or Firm*—Abelman, Frayne & Schwab

(57) ABSTRACT

A system for releasably attaching an article of luggage such as a first carry bag, with or without a pair of upright support members, to a second carry bag system or wheeled luggage cart having at least a pair of upright stationary support members is disclosed in which a handle is resiliently attached to the first carry bag, and a device is provided for resiliently attaching the handle to the first carry bag in a manner to permit rotation of the handle between a first storage position between a pair of upright support members of the second carry bag system and a second interference position with the upright support members of the second carry bag system to thereby attach the first carry bag to the upright support members of the second carry bag system. The handle is preferably in the form of a zippered pouch having a planar plate attached thereto for engagement with the upright support members.

25 Claims, 9 Drawing Sheets

U.S. PATENT DOCUMENTS 798,531 A * 8/1905 Reicke ..... 190/102
867,403 A * 10/1907 Newson ..... 24/3.1
1,958,587 A * 5/1934 Hiscocks et al. ..... 16/405
1,979,978 A * 11/1934 Martin ..... 190/115
2,784,816 A * 3/1957 Goldberg ..... 190/115
3,198,300 A 8/1965 Tuttle
4,759,431 A 7/1988 King et al.
5,464,080 A 11/1995 Liang
5,533,600 A 7/1996 Van Himbeeck et al.
5,555,960 A 9/1996 Bartsch
5,560,458 A 10/1996 Franklin et al.
5,660,476 A * 8/1997 DeCoster ..... 383/29
5,685,401 A * 11/1997 Macgillivray et al. ..... 190/108
5,699,886 A 12/1997 Latshaw
5,722,518 A 3/1998 Aumasson
5,749,446 A * 5/1998 Hsieh ..... 190/107
5,762,169 A 6/1998 Deliman et al.
5,769,194 A 6/1998 Chang
5,890,571 A 4/1999 Sadow
5,927,450 A 7/1999 Sadow
5,951,037 A * 9/1999 Hsieh et al. ..... 280/655
5,988,334 A * 11/1999 Caruso ..... 190/18 A
6,070,888 A * 6/2000 Wang ..... 280/37
6,964,420 B1 * 11/2005 Ghanizadeh et al. ... 280/47.131
2003/0038008 A1 2/2003 Han
2003/0196860 A1 * 10/2003 Be ..... 190/18 A
2004/0238304 A1 12/2004 Fisher
2005/0082131 A1 4/2005 Fenton et al.
2005/0103589 A1 5/2005 Russo et al.
2006/0226619 A1 * 10/2006 Sadow ..... 280/47.26

* cited by examiner

FIG. 1
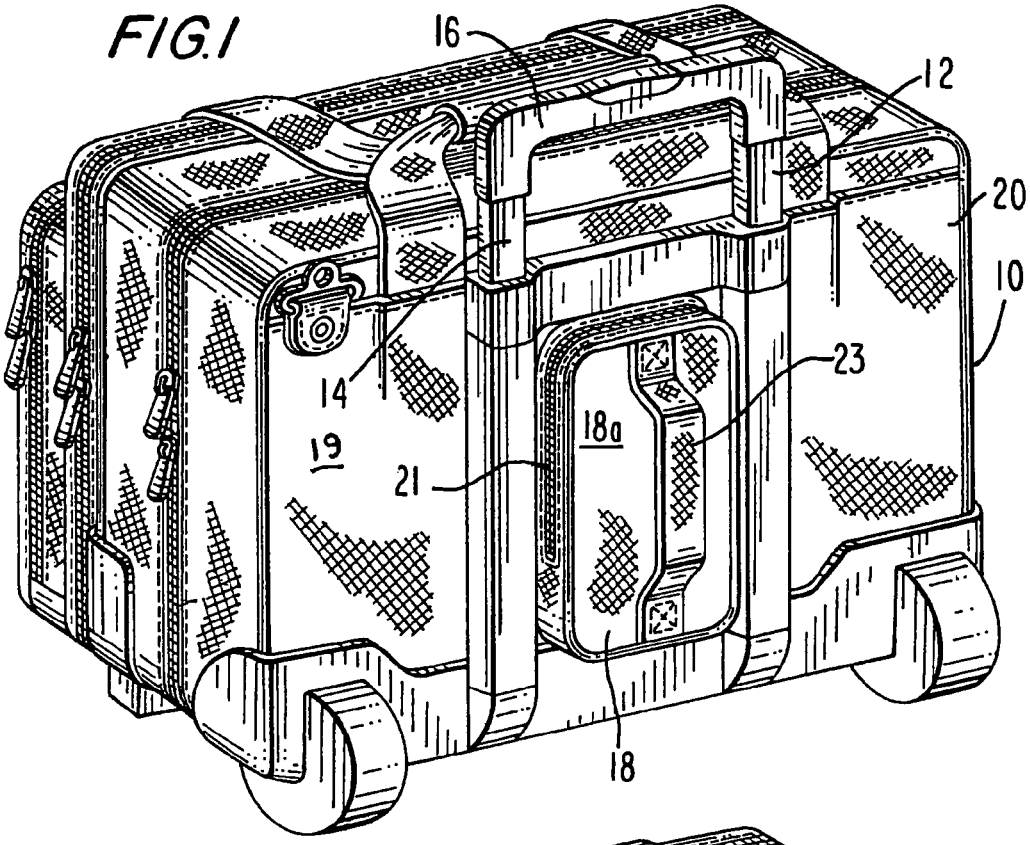
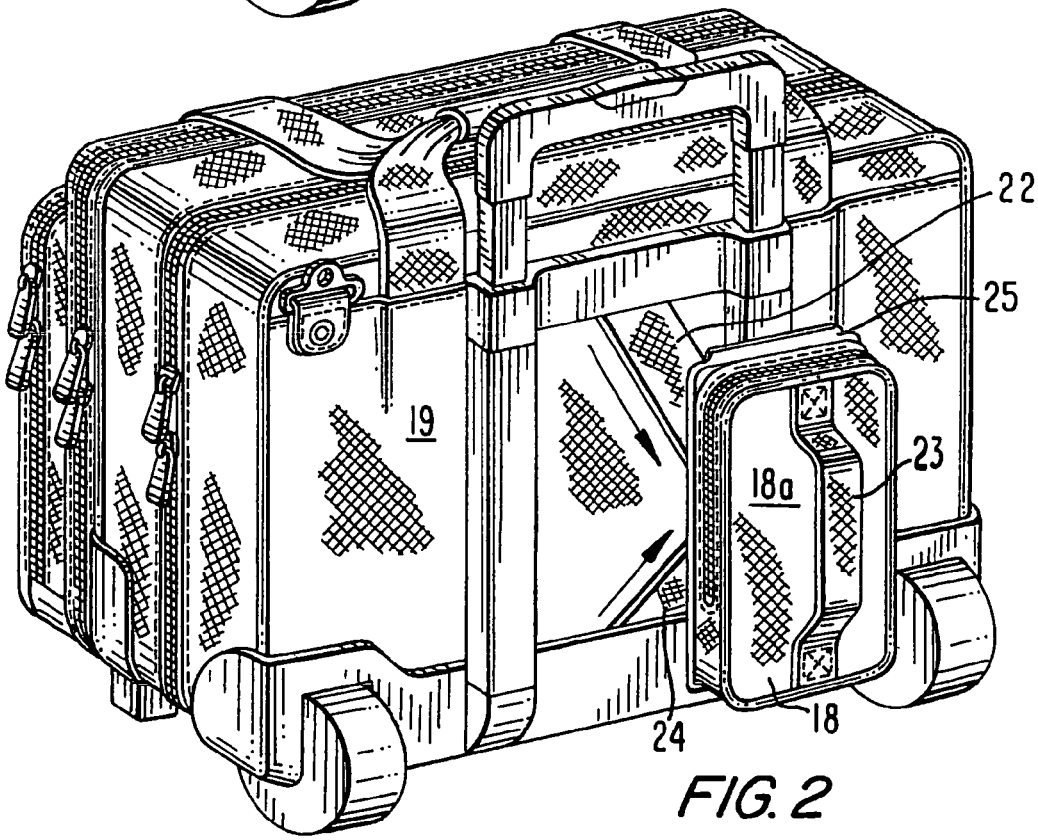
FIG. 2

FIG. 4
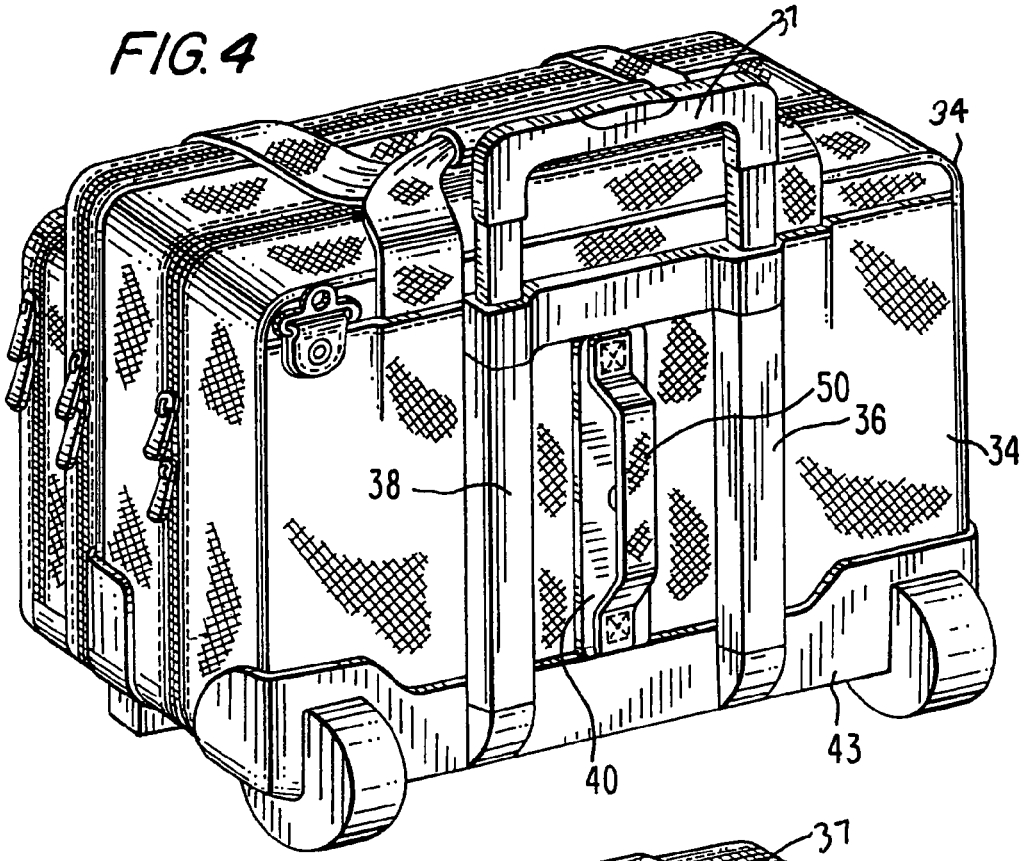
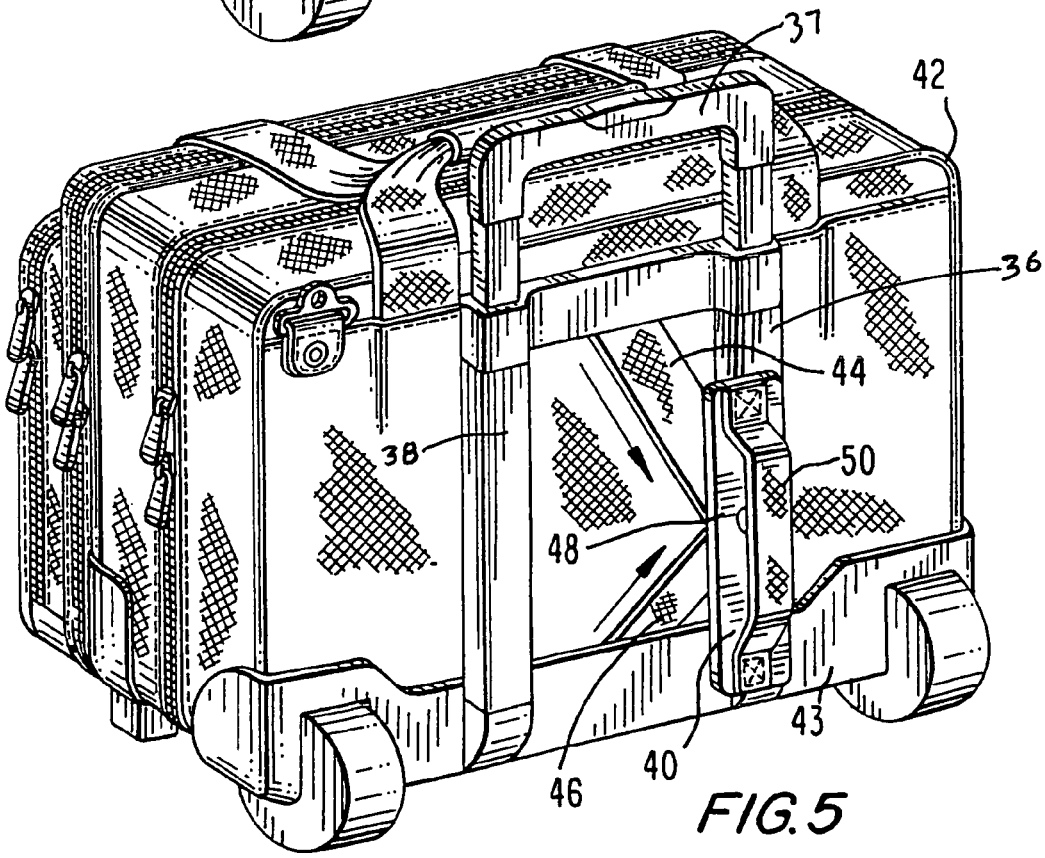
FIG. 5

37
72
74
73
71
62
75
64
60
68
66
64
68
77
70
43

FIG. 9
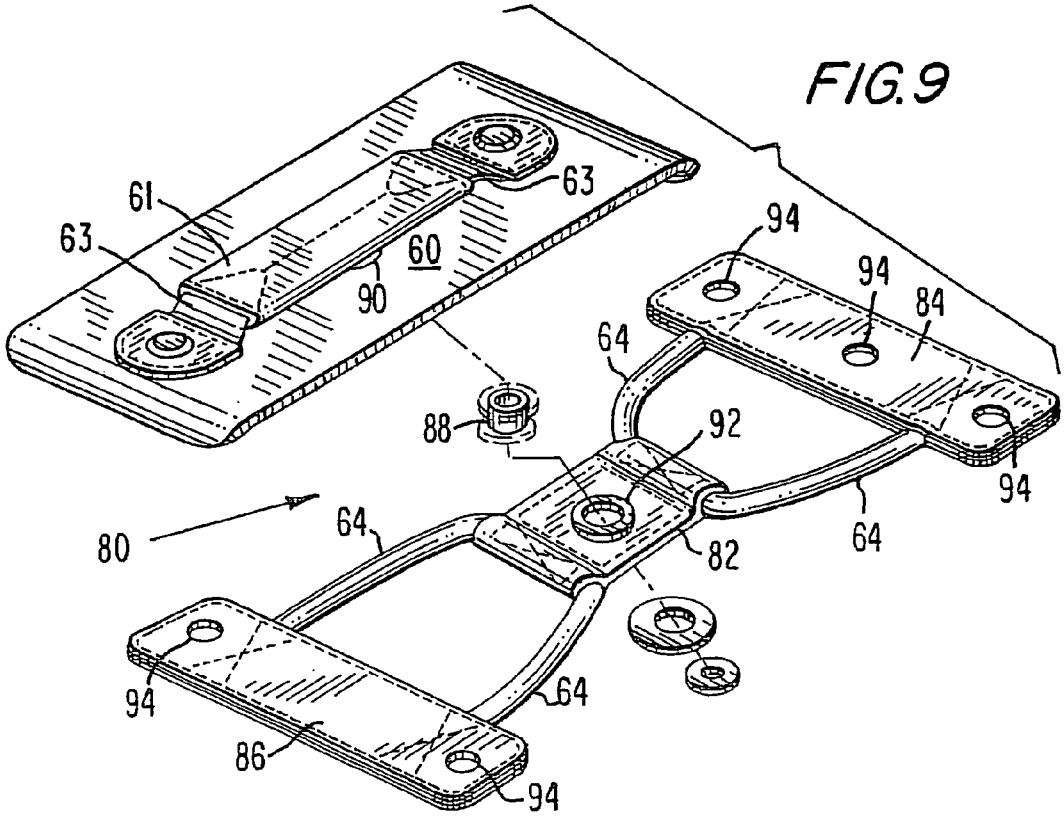
FIG. 10
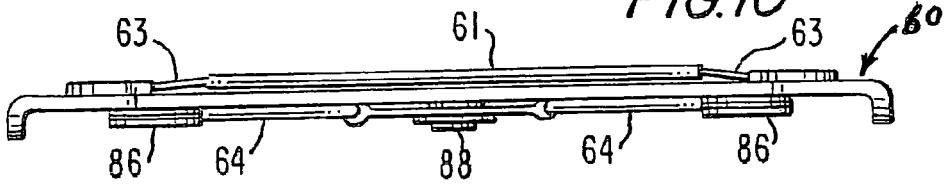
FIG. 11
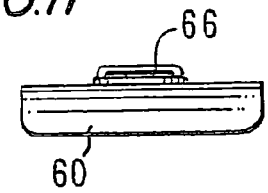
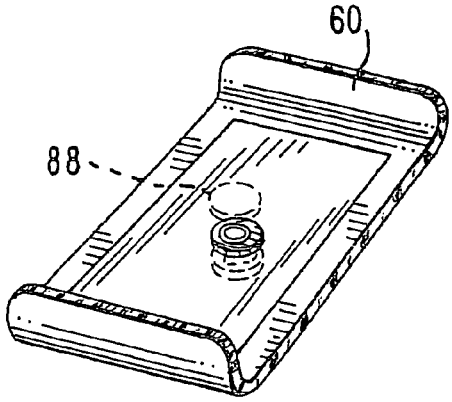
FIG. 12

FIG. 13
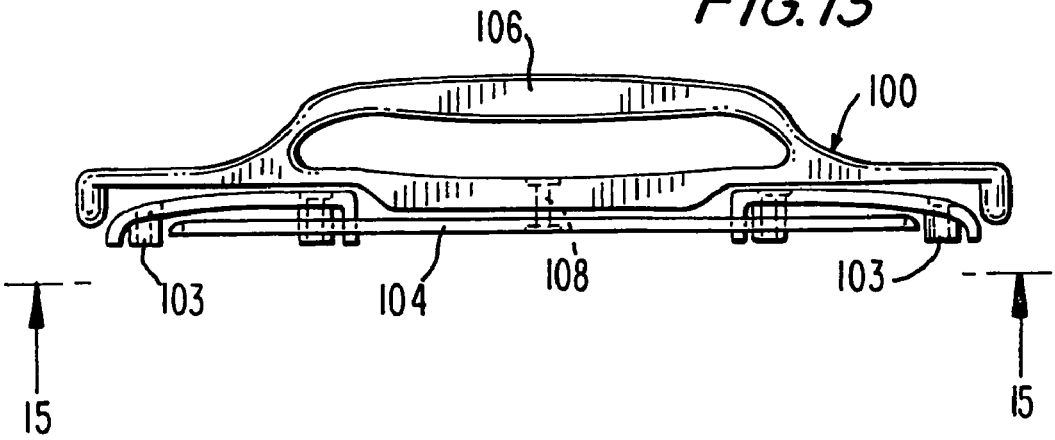
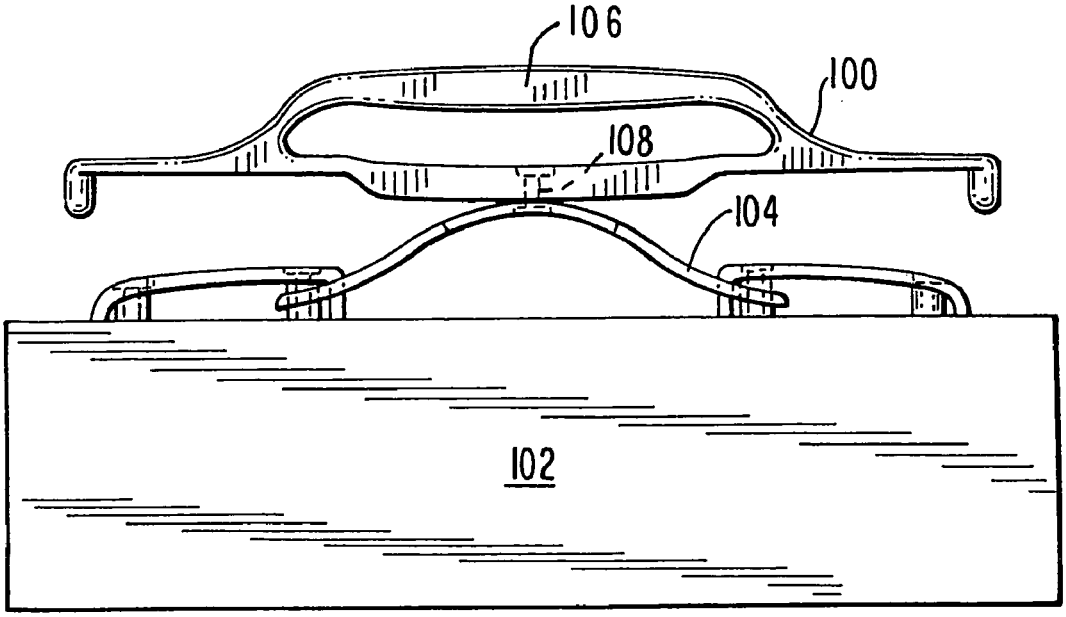
FIG. 14
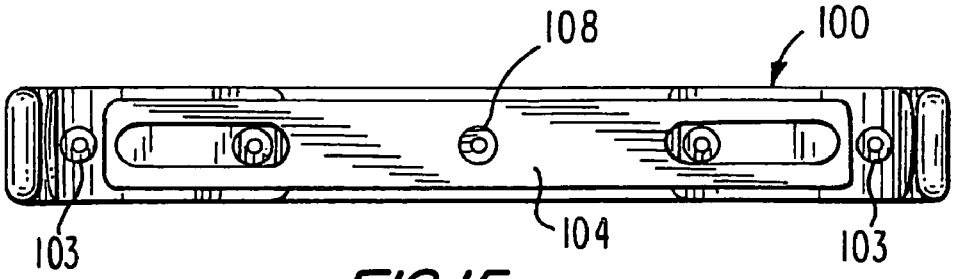
FIG. 15

FIG. 16
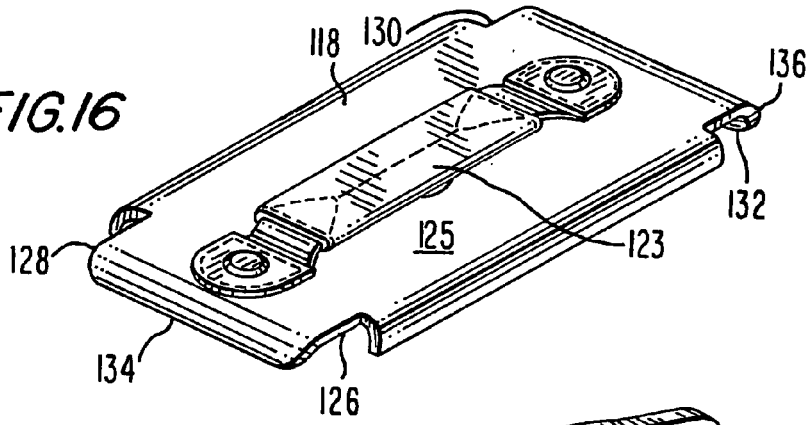
FIG. 17
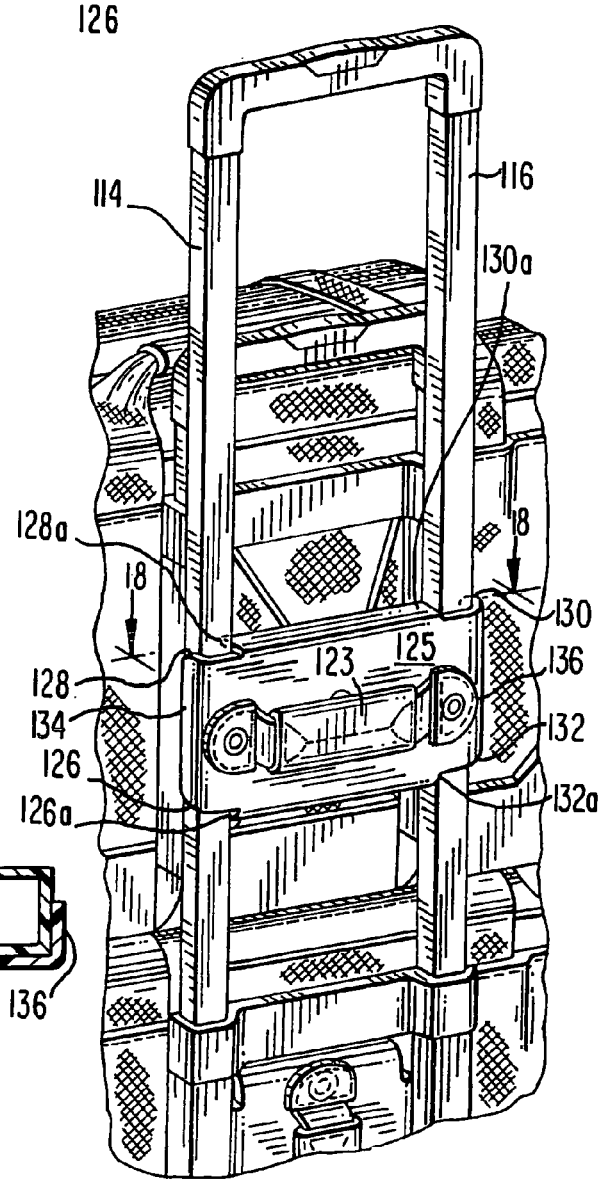
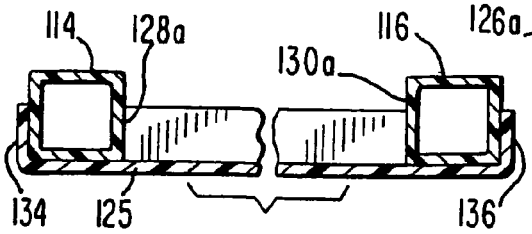
FIG. 18

ROTATABLE HANDLE AND METHOD FOR ATTACHING A FIRST CARRY BAG SYSTEM TO A SECOND CARRY BAG SYSTEM, AND CARRY BAG HAVING SAME

CROSS-REFERENCE TO RELATED APPLICATIONS

This application claims priority to provisional application No. 60/682,222, filed May 17, 2005, the disclosure of which is incorporated by reference herein and made a part of this application.

BACKGROUND OF THE INVENTION

1. Field of the Invention

The invention relates to devices for releasably attaching a carry bag, or item of luggage, onto the handle system of another carry bag or wheeled cart having upright supports. In particular, the present invention relates to a rotating handle for accomplishing such attachment objective, and a carry bag system having such rotating handle.

2. Description of the Related Art

Present day carry bags such as items of luggage with extendible tubular handles, or carry carts with such extendable handles generally utilize elastic ties such as bungee style resilient expandable cords with hooks or clips to attach a bag to the handle system. In general, such attachment systems are supplied separate from the carry bag or related handle and are somewhat cumbersome to utilize, since they often require strategic placement of the attachment devices and hooks to secure the bag in place. In addition, placement of the expandable cords often involves stretching the cords, a procedure which can sometimes be dangerous in that the cord can be accidentally released and cause injury.

At present, a convenient system for attaching items of luggage together or to transport devices such as luggage carts has not been developed.

SUMMARY OF THE INVENTION

The present invention relates to a rotatable handle system which is resiliently attached to an item of luggage such as a carry bag, and which is adapted to be quickly manipulated in a manner to releasably attach the bag to the handle system of another such carry bag, or to a wheeled carry cart.

A carry bag system is disclosed for attaching a first carry bag system to a second carry bag system or to a wheeled luggage cart having upright support members, which comprises a carry bag and a handle resiliently connected to one wall of the carry bag, the handle being dimensioned, structured and connected to rotate between a first storage position and a second attaching position, whereby in the second position the handle may be placed in attaching relation with one or more of the upright support members. The handle preferably has a generally elongated configuration, and preferably may be rectangular or oval in configuration. However, any elongated shape will suffice.

The device for resiliently attaching the handle to the first carry bag can be at least one resilient member attached at one end to the handle, and at the other end to the second carry bag. Alternatively, the handle may be resiliently attached to the second carry bag by a plurality of resilient members. Still alternatively, the handle may be resiliently attached to the first carry bag by at least two resilient woven straps, each strap being attached at one end to a wall of the second carry bag, and at the other end to the handle by a device which permits rotation of the handle relative to the strap or straps.

The handle may also be resiliently attached to the first carry bag by at least two resilient bungee cords, each cord attached at one end to a rear wall of the second carry bag, and at the other end to the handle by a device which permits rotation of the handle relative to the bungee cords. Further, the handle may be resiliently attached to the first carry bag by at least four resilient bungee cords, each cord is attached at one end to a rear wall of the first carry bag, and at the other end to the handle by a device which permits rotation of the handle relative to the bungee cords.

The handle may further comprise a gripping handle attached thereto to facilitate manually moving the handle between the storage position and the position in engagement with the support members. Also, the handle may be configured as a pouch for carrying articles, and at least one side of the handle may include a plate member for engagement with the support members. Preferably, the pouch and the plate member are generally rectangular or oval in shape. Any shape is preferred, provided that the handle interferes with the upright supports when positioned in the attaching orientation. The pouch preferably includes a zipper closure for opening and closing the pouch position.

Preferably the plate member is generally planar and is made of metal or plastic. Further, the plate member preferably includes cutout portions shaped generally similar to the outer surfaces of the support members for complementary engagement therewith.

In particular, the invention relates to a system for releasably attaching an article of luggage such as a first carry bag to a second carry bag system or to a wheeled luggage cart having at least a pair of spaced upright support members, when the first carry bag is positioned atop the second carry bag, which comprises a handle dimensioned in at least one direction to interfere with and engage the support members when positioned thereagainst in at least one predetermined orientation generally transverse to the support members. A device is provided for resiliently attaching the handle to the first carry bag in a manner to permit storage of the handle in a first position and to facilitate resilient movement of the handle away from the first bag, and permit rotation of the handle between the first storage position and the at least one predetermined orientation such that when the handle is retracted toward the first carry bag, the handle engages the support members of the second carry bag system to thereby engageably attach the first carry bag to the upright support members of the second carry bag system.

The system preferably comprises a handle having a generally elongated configuration, and a device for resiliently attaching the handle to the first carry bag in a manner to permit rotation of the handle between a first storage position and a second interference position with the upright support members of the second carry bag system to thereby permit attachment of the second carry bag to the upright support members of the second carry bag system.

The invention also relates to an article of luggage adapted for attachment to a carry bag system having a carry bag and at least a pair of upright support members, or to a wheeled luggage cart having at least a pair of upright support members, which comprises a handle preferably dimensioned in at least one direction for storage between the support members when the article of luggage is positioned atop the first mentioned carry bag. The handle is dimensioned in at least a second direction to interfere with and engage the support members when positioned thereagainst in at least one predetermined orientation generally transverse to the support members. Means is provided for resiliently attaching the handle to the article of luggage in a manner to permit the handle to be rotated between the storage position and the interference position. The handle preferably comprises at least one plate-like member, and a pouch attached thereto for storage or articles therein. Further, the handle is preferably rectangular or oval in shape.

The invention also relates to a method for attaching a first carry bag system to a second carry bag system having a second carry bag and at least a pair of spaced apart upright support members, wherein the first carry bag system includes a carry bag having a handle attached thereto by resilient means in a manner which permits rotation thereof between a first storage position between the support members when the first carry bag is positioned atop the second carry bag, and a second attaching position generally transverse to the support members of the second carry bag system and in engagement therewith. The method comprises positioning the first carry bag atop the second carry bag, gripping the handle and moving it away from the first carry bag and through the support members of the second carry bag system, rotating the handle to an orientation which interferes with the support members of the second carry bag system, and permitting the handle to be drawn toward the first carry bag by the resilient means until it engages the upright support members of the second carry bag system, to thereby attach the first carry bag system to the second carry bag system. According to the method of the invention, the orientation of the handle which interferes with the support members of the second carry bag system is generally transverse to the support members.

BRIEF DESCRIPTION OF THE DRAWINGS

Preferred embodiments of the invention are disclosed hereinbelow with reference to the drawings, wherein:

FIG. 1 is a rear perspective view from above, of one preferred embodiment of the invention, illustrating the rotating handle of the invention in position between a pair of extendible tubular handles to which the carry bag is attached;

FIG. 2 is a rear perspective view from above, of the bag and carry system of FIG. 1 with the rotatable handle extended away from the bag via elastic resilient attachment devices;

FIG. 4 is a rear perspective view from above, of an alternative preferred embodiment of the present invention, wherein the rotating securing handle is in the form of a relatively narrow plate having a gripping handle attached to elastic webbing;

FIG. 5 is a rear perspective view from above of the carry bag and rotating handle system of FIG. 4 with the rotating handle system extended rearwardly away from the carry bag by the elastic webbing, ready for rotation to the carrying position;

FIG. 9 is a perspective view from above, of the single bungee rotatable handle assembly of FIG. 7, with parts separated for illustration purposes, the side edge of the handle 60 shown cross-hatched for metal, and intended for illustration purposes only as an example of one embodiment;

FIG. 10 is a side view of the rotatable handle assembly of FIG. 8;

FIG. 11 is an end view of the rotatable handle assembly of FIG. 8;

FIG. 12 is a perspective view from above of the underside of the handle of FIG. 9, the side edge of the handle 60 shown cross-hatched for plastic, intended for illustration purposes only as an example of another embodiment;

FIG. 13 is a side view of still another preferred embodiment of the rotating handle system of the invention, incorporating spring metal resilient attachment members in place of the bungee cords;

FIG. 14 is a side view of the handle system of FIG. 13, showing the handle extended away from the attached bag, the bag shown phantom lines;

FIG. 15 is a perspective view of the underside of the handle of FIG. 13 taken along lines 15-15 of FIG. 13;

FIG. 16 is a perspective view from above, of an embodiment of the rotatable handle which includes cutout portions at each end to conform the handle to the outer configuration of the extendible tubular supports of the system to which the bag is to be attached;

FIG. 17 is a rear perspective view of a system according to the present invention, incorporating the embodiment of the handle shown in FIG. 16; and FIG. 18 is a cross-sectional view taken along lines 18-18 of FIG. 17.

DETAILED DESCRIPTION OF THE PREFERRED EMBODIMENTS

Figure 3:
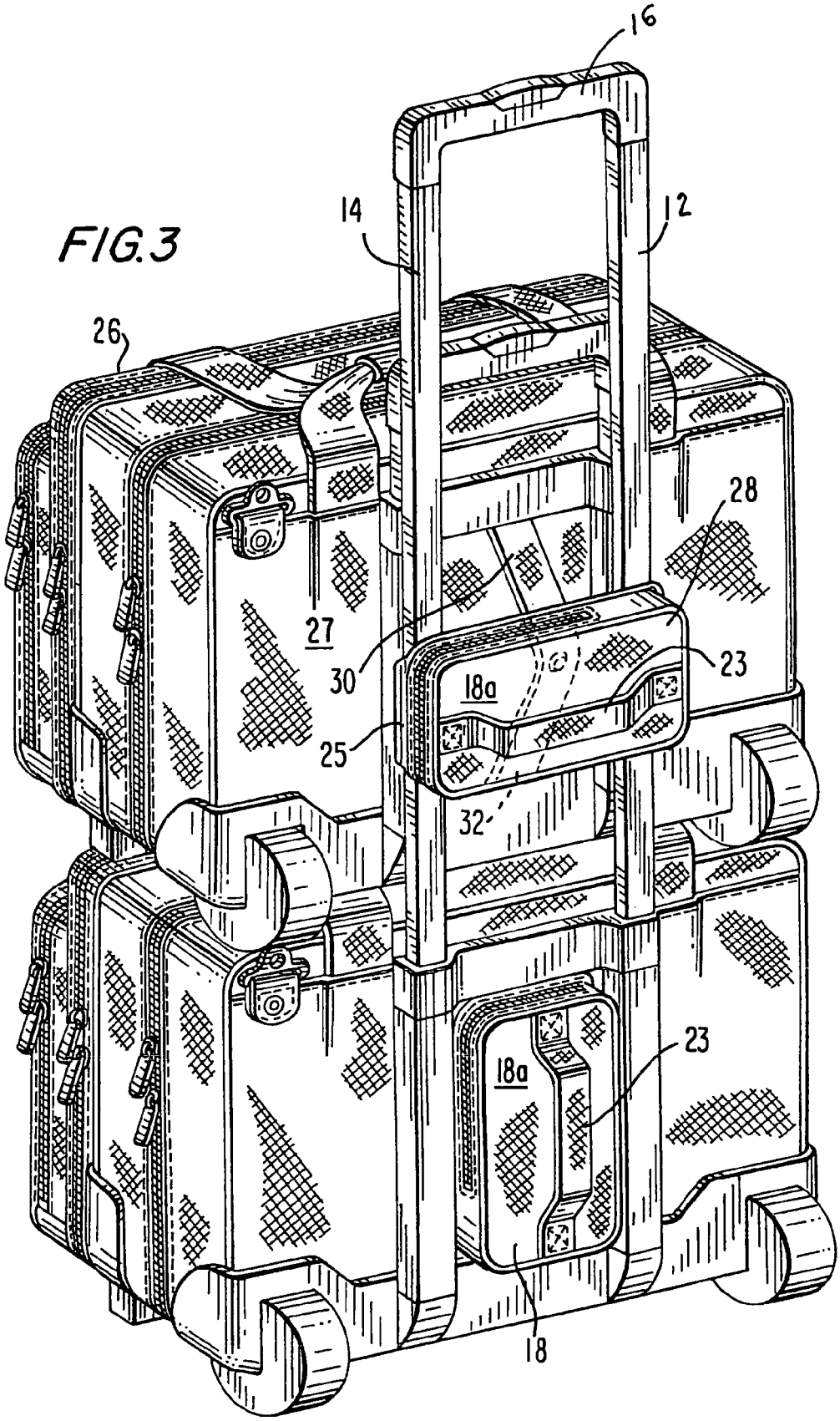
FIG. 3 is a rear perspective view from above, of the carry bag and handle system of FIGS. 1 and 2 illustrating a first carry bag secured to the pair of vertical handles of the carry system utilizing a rotating securing handle constructed according to the present invention.

Referring initially to FIG. 1 there is shown a bag 10 having mounted thereto an extendible handle system having a pair of parallel tubular supports 12,14 connected by gripping handle 16 and extendible to the position shown in FIG. 3.

Rotatable attachment handle 18 is attached to the rear wall 19 of bag 20 via resilient connectors 22,24 to permit resilient movement of handle 18 rearwardly away from bag 20 by grasping gripping handle 23. Since attachment handle 18 is actually rotatably attached to resilient connectors 22,24 (i.e., resilient woven straps) by a rivet or other fastener as will be described hereinbelow, the handle 18 readily be selectively rotated to either a horizontal attachment position, or the vertical storage position as shown. Handle 18 may be configured as a pouch, or pocket, having zipper 21, which permits access to the inner storage area for storing articles or the like.

Handle 18 is formed as a pocket or pouch 18*a* as shown, and includes a planar member such as plate 25 intended for direct engagement with tubular supports 14, 12 as will be described hereinbelow. Plate 25 may be made of plastic, metal or the like, and is configured to have at least one dimension which is sufficient to cause it to interface with upright tubular supports 14, 12 when it is positioned thereagainst in transverse relation thereto. In the embodiment shown, the plate 25 is rectangular. Pocket 18*a* may optionally be the same size as plate 25 as shown, or it may be of lesser or greater dimensions. However, the combination of pocket 18*a* and plate 25 is considered to be handle 18 for the purpose of the present description.

Referring to FIG. 3 there is shown a second carry bag system 26 identical to carry bag system 10 of FIG. 1, except that the first carry bag system is attached to the parallel tubular supports 14, 12 by first extending the rotatable handle 28 rearwardly away from carry bag 27, and then rotating it to a horizontal interference position between the tubes.

Thereafter, the handle 28 is released to permit the resilient members 30, 32 to draw the handle 28 forwardly toward the parallel tubular supports 14, 12 to complete the attachment of the first bag system 26 to the second bag system 10. Axle, wheel and bag support system 43 is provided to permit moving the carry bags 20, 27 from place to place.

Referring now to FIG. 4 there is shown an alternative embodiment of the present invention wherein a carry bag system 34 includes parallel tubular-type upright support members 36, 38 connected by gripping handle 37. Rotatable handle 40 is attached to the rear portion of the carry bag 42 via resilient elastic members 44, 46 as shown in FIG. 5.

Figure 6:
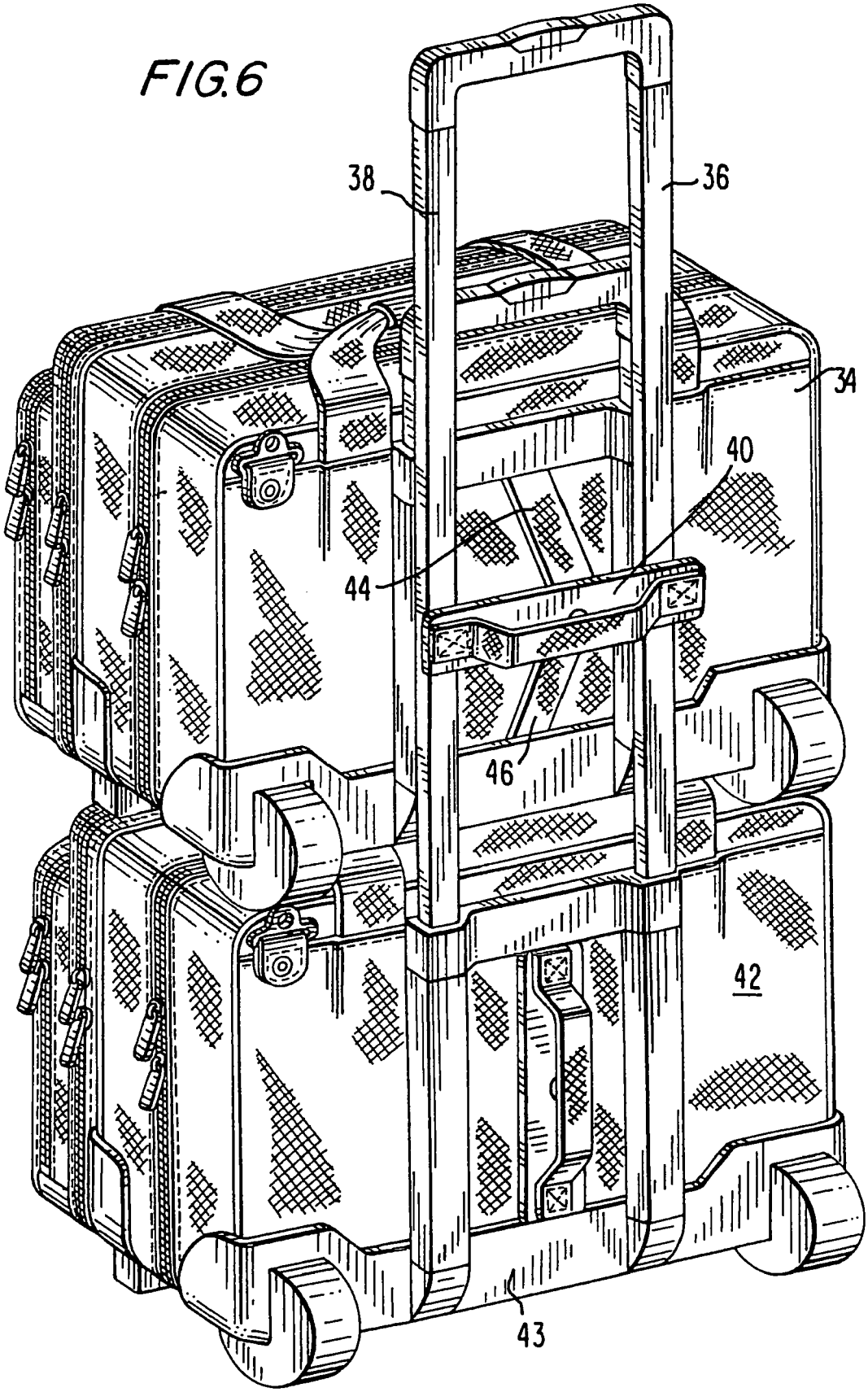
FIG. 6 is a rear perspective view from above of a carry system of FIGS. 4 and 5, illustrating a lower carry bag having the rotating handle constructed according the present invention in the stored position, and a second upper carry bag attached to a pair of extendible tubular supports of the lower carry bag system for attaching the first upper carry bag to the tubular supports of the lower carry bag utilizing the rotating handle system of FIGS. 4 and 5.

As shown in FIGS. 4-6, the rotatable handle is in the form of a relative narrow plate 48 having a gripping handle 50 suitably attached thereto for gripping and withdrawing the rotatable handle rearwardly of the carry bag for releasable attachment purposes as described previously. The handle is rotatably attached to the resilient members by a rivet or other fastener as will be described hereinbelow.

In the embodiment of FIGS. 4-6, the rotatable plate 40 and handle 50 is rotatably attached to resilient fabric-type (i.e., resilient woven straps) connectors 44, 46 which are attached to the carry bag by stitching or otherwise at one end, and to the plate 40 at the other end by a rivet or other fastener arrangement which permits handle rotation, utilizing a plate or leather base as a connector. The sequence of operation of attachment of carry bag 34 to the carry bag system 42 shown in FIGS. 4-6 is self evident and identical to that described in connection with the previous embodiments. Wheel system 43 is provided to permit movement of the carry bags 34 and 42 together as a single unit when attached as described herein.

Figure 7:
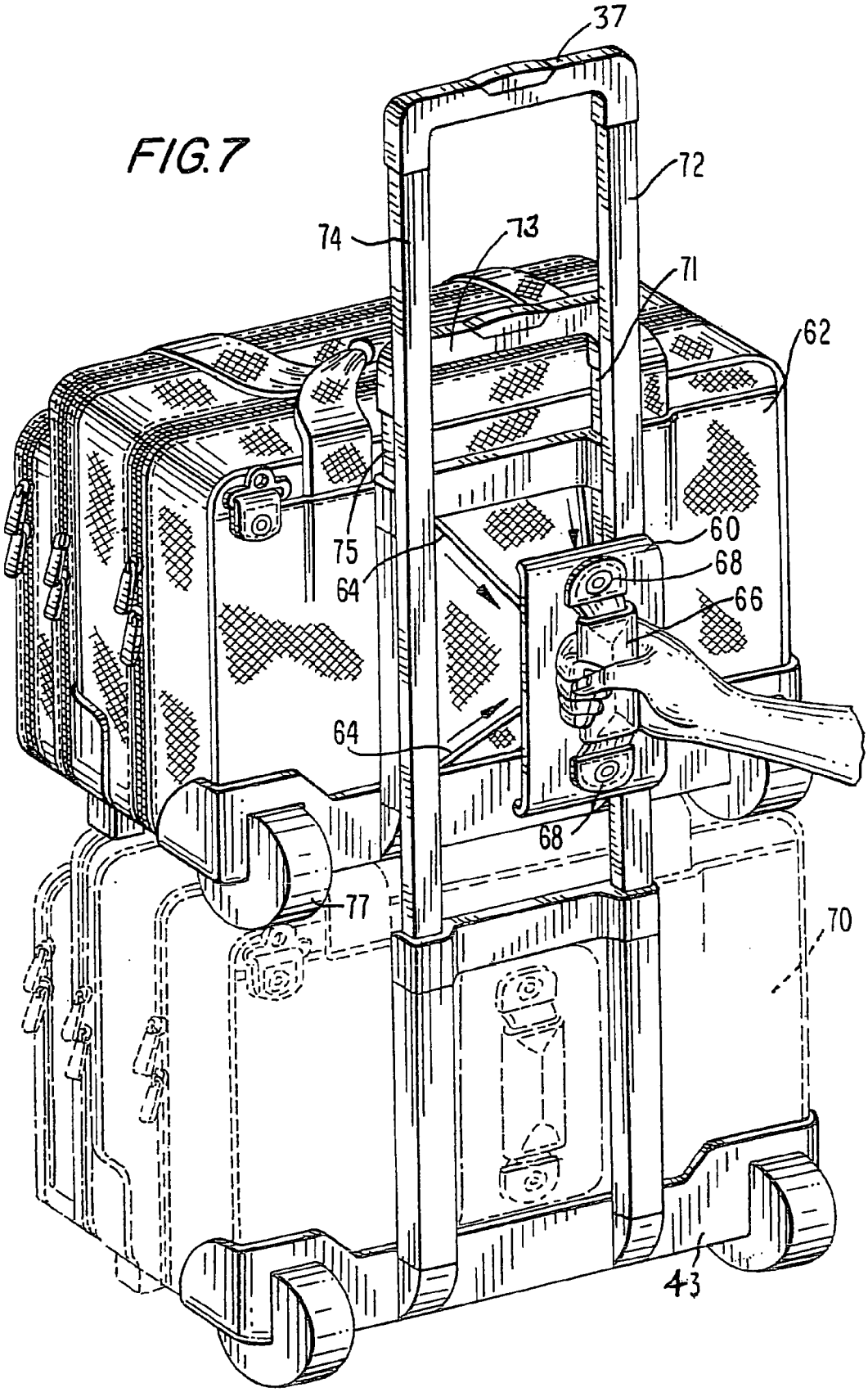
FIG. 7 is a rear perspective view from above of another preferred embodiment of the present invention, showing a rotatable handle attached to a carry bag by a system of elastic single bungee cords, illustrating the handle in the first position pulled away from the bag prior to rotation to the position to attach it to a second carry bag system or luggage cart, a lower supporting carry bag shown in phantom lines for illustration purposes.
Figure 8:
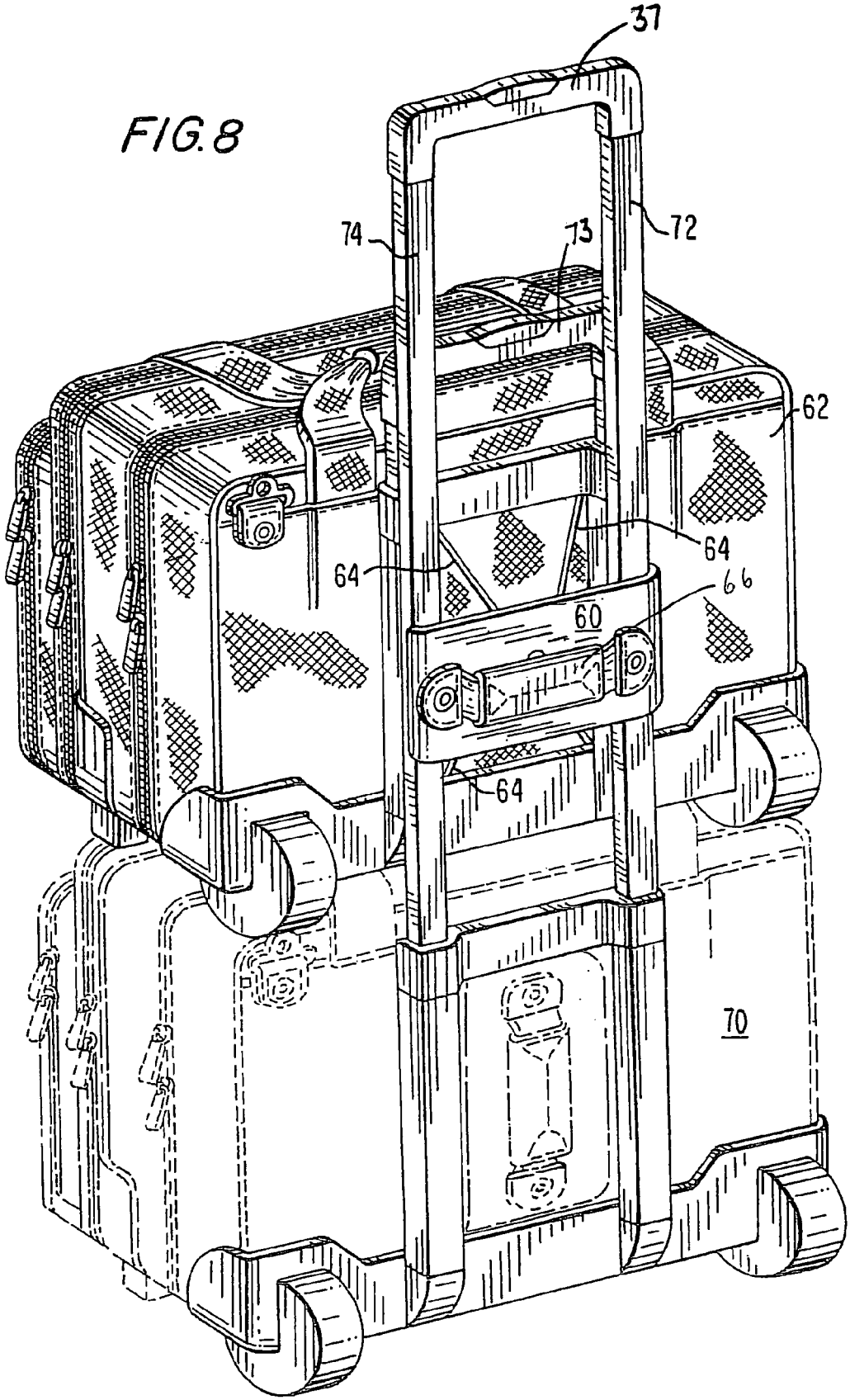
FIG. 8 is a rear perspective view from above, of the carry bag and rotatable handle assembly of FIG. 7, with the handle rotated and positioned to the bag attaching position, a lower supporting bag shown in phantom lines for illustration purposes.

Referring now to FIGS. 7 and 8, there is shown another preferred embodiment of the rotatable handle 60 of the present invention attached to carry bag 62 by four resilient single bungee (i.e., non-metal elasticized rubber) connectors (or cords) 64. Alternatively, rather than using four cords as shown, the handle may be attached by one or two of such cords (not shown), but in the same manner as is shown. The handle 60 has gripping handle 66 attached by rivets or other fasteners 68 as shown, and may be in the form of a strap, a molded grip, or a section of rope. Tubular supports 72, 74, 71, 75 are connected by gripping handles 37 and 73, respectively, as shown in FIGS. 7 and 8.

In operation the carry bag 62 is first positioned atop the lower carry bag 70 shown in phantom lines over lower support shelf 73 for illustration purposes, and thereafter the user grips handle 60 via gripping handle 66, and it extends rearwardly of the carry bag as shown. Although the handle 60 can be configured in a variety of shapes, in general, it should be dimensioned sufficiently narrow in one direction to fit between the upright tubular supports 72,74,71,75 when in the stored position, and of sufficient length in at least one other direction to interfere with the tubular supports 72,74 when it is rotated, preferably 90 degrees to the position of interference with tubular supports 72, 74 as shown in FIG. 8. Thereafter the handle 60 is slowly released to permit bungee cords 64 to withdraw the handle 60 toward the carry bag 62 to engage tubular supports 72, 74 to complete the attachment of carry bag 62 to the carry bag 70 and associated supports 72, 74. Carry bag 62 has its own system of tubular supports 71, 75 and wheels 77 for use with another bag system in the same manner, and for transporting carry bag 62, respectively. It can be seen that the handle can be rectangular, oval or any alternative generally elongated shape, provided that it will interfere with the supports when in the attachment position. Preferably the handle has a transverse (or widthwise) dimension that enables it to fit between the upright supports when in the stored position, and it will interfere with the supports when in the attachment position.

Referring now to FIG. 9 there is shown the preferred single bungee cord connecting system 80 for the embodiment of FIGS. 7 and 8. Similar arrangements can be utilized for the embodiments of FIGS. 1-6.

In FIG. 9 single bungee cords (i.e., non-metallic elastic) cords 64 are attached to a central section 82, preferably of leather, at one end, and to polyethylene (PE) or leather boards 84, 86 at the other ends as shown. Other semi-rigid or rigid materials are contemplated. Central leather section 82 is then attached to the underside of handle 60 by rivet 88, or other fastener device, through aperture 90 to handle 60 through aperture 92 in central leather section 82. Gripping handle 66 is shown in FIG. 11. Leather boards 84, 86 are then respectively attached to the rear wall of the carry bag via apertures 94 as shown in the previous views, by suitable fasteners, thereby in effect, attaching handle 60 to the carry bag with bungee cords 64 intermediate the handle and the carry bag. Alternatively boards 84, 86 can be attached to the carry bag by stitching or any other known technique. In place of rivet 88, a spool may be provided in two threaded parts for assembly and disassembling purposes.

FIG. 10 is a side view of the assembled components of FIG. 9 showing gripping handle 61 attached to rotatable handle 60 by leather connectors 63, and showing single bungee cords 64 attached to the underside of handle 60 by leather end connectors 86.

FIG. 11 is an end view of the rotating handle assembly of FIG. 8.

FIG. 12 is a perspective view from above, of the underside of the rotatable handle of FIG. 9, showing connecting rivet 88 (or two part spool) in phantom lines.

It should be understood that the single bungee cords of the embodiment of FIGS. 9-12 can be substituted by double or triple bungee cords, not shown. In addition, the present invention can be incorporated in carry bags having their own tubular supports, or carry bags having no tubular supports, but releasably attachable to carry bags or wheeled carts with tubular supports.

Referring now to FIGS. 13 and 14, there is shown another alternative embodiment of the present invention, having handle 100 rotatably attached to a carry bag 102 (shown in FIG. 14) by resilient spring metal connectors 104. The handle 100 which may be of molded polymeric material includes hand grip 106 as shown, and is connected to spring metal connectors 104 via rivet 108 or other suitable fastening device. Spring metal connectors 104 are in turn connected to the carry bag 102 via end attachment devices 103 which are attached to bag 102 as shown in FIG. 14.

FIG. 14 shows the rotatable handle system of FIG. 13 in position withdrawn away from the rear wall of the carry bag 102 in position or prior to rotation to an interference position with upright supports associated with another carry bag as shown in and described in connection with the previous views.

FIG. 15 is a bottom view of the handle system shown in FIGS. 13 and 14.

FIGS. 16-18 illustrate an embodiment of the invention wherein handle 118 is formed only as a generally planar plate member 125 having handle grip 123 attached thereto. Plate member 125 has cutout portions 126, 128, 130, 132 at each end as shown to permit plate member 125 to conform to the outer shape of upright support members 114, 116 as shown in FIGS. 17 and 18 to lock into position by interference relation with the support members as shown at 126*a*, 128*a*, 130*a* and 132*a*. For example, if the upright support members have square or rectangular cross-sections as shown, cutouts 126, 128, 130, 132 and bent ends 134,136 may be made to be square, to complement the outer surfaces of the support members and snap into position as shown. Alternatively, if the upright support members have another outer shape (i.e., circular), then the cutouts will be correspondingly shaped to conform the handle at each end to the shape of the upright support members and the bent ends can be arcuate to provide complementary locking engagement therewith and substantial surface contact therebetween.

It should be understood that in each of the embodiments described hereinabove, the rotatable handle can be made of a polymeric molded material preferably covered by the same fabric as the carry bag. The manual gripping handle can be made of a flexible material or it can be made of a fabric strap or leather strap or rope that matches the carry bag. Alternatively the grip may be a leather strap as well. The rotatable handle can also be made of metal with or without fabric covering.

In addition, the carry bag of the present invention can be releasably attached to the well known wheeled luggage carts having upright supports in the same manner as described hereinabove.

It should be understood that the various features shown and described hereinabove, can be varied from embodiment to embodiment, utilizing features of one of the embodiments with features of the other embodiments and vice a versa, so as to provide various combinations of features in the rotatable handle system for attaching a first carry bag system to a second carry bag system, wheeled luggage cart and the like.

What is claimed is:

1. A system for releasably attaching a first carry bag system having a first carry bag, to a second carry bag system having a second carry bag and at least a pair of spaced apart upright support members, or to a wheeled luggage cart having at least a pair of spaced apart upright support members, which comprises:

a) a first carry bag; and b) a handle resiliently connected to one wall of said first carry bag, said handle being dimensioned, structured and adapted to rotate between a first position and a second attaching position, whereby in the second attaching position, said handle may be placed in engaged relation with the pair of spaced apart upright support members to releasably attach said first carry bag to the pair of spaced apart upright support members to be transported therewith, and when said handle is rotated to said first position, said handle is dimensionally capable of passage between the pair of upright support members, whereby said first carry bag is separable from the pair of upright support members.

2. The system according to claim 1, wherein said handle has a generally elongated configuration.

3. The system according to claim 2, wherein said handle has a generally rectangular configuration.

4. The system according to claim 3, wherein said handle is attached to said first carry bag by at least one resilient member attached at one end to said handle, and at the other end to said first carry bag.

5. The system according to claim 4, wherein said handle is resiliently attached to said first carry bag by a plurality of resilient members.

6. The system according to claim 5, wherein said handle is resiliently attached to said first carry bag by at least two resilient woven straps, each said strap being attached at one end to a wall of said first carry bag, and at the other end to said handle by a device which permits rotation of said handle relative to said straps.

7. The system according to claim 5, wherein said handle is resiliently attached to said first carry bag by at least two resilient elasticized cords, each said cord attached at one end to a rear wall of said first carry bag, and at the other end to said handle by a device which permits rotation of said handle relative to said elasticized cords.

8. The system according to claim 7, where said resilient elasticized cords are rubber cords.

9. The system according to claim 7, wherein said handle is resiliently attached to said first carry bag by at least four resilient elasticized cords, each said cord attached at one end to a rear wall of said first carry bag, and at the other end to said handle by a device which permits rotation of said handle relative to said elasticized cords.

10. The system according to claim 9, wherein said handle further comprises a gripping handle attached thereto to facilitate manually gripping and moving said handle between said storage position and said attaching position for engagement with said support members.

11. The system according to claim 10, wherein at least a portion of said handle is configured as a pouch for carrying articles, and at least one side of said handle includes a plate member for engagement with the upright support members.

12. The system according to claim 11, wherein said pouch and said plate member are generally rectangular in shape.

13. The system according to claim 12, wherein said handle includes a zipper closure for opening and closing said pouch.

14. The system according to claim 12, wherein said plate member is generally planar and is made of at least one of metal and plastic.

15. The system according to claim 13, wherein said plate member includes cutout portions shaped generally similar to the outer surfaces of said upright support members for complementary engagement therewith.

16. A system for releasably attaching a first carry bag to a second carry bag system having a second carry bag and at least a pair of spaced apart upright support members, said first carry bag being positionable atop said second carry bag, which comprises:

a) a handle dimensioned along at least a first direction to pass through said pair of upright support members when placed in a first position generally parallel thereto, said handle being dimensioned along a second direction to interfere with and engage the support members when rotated to a second position generally transverse to said support members; and b) a device for resiliently and rotatably attaching said handle to said first carry bag in a manner to permit passage of said handle between the pair of upright support members when said first carry bag is positioned adjacent thereto, and to facilitate resilient movement of said handle toward and away from said first carry bag, and permit rotation of said handle between first and second positions, such that when said handle is placed in said second position and is retracted toward said first carry bag, said handle engages the upright support members to engageably and releasably attach said first carry bag to the upright support members for transporting therewith, and when said handle is rotated to said first position, said handle is dimensionally capable of passage between the pair of upright support members, whereby said first carry bag is separable from the pair of upright support members.

17. A system for releasably attaching a first carry bag system having at least a first carry bag and at least a first pair of upright support members extending therefrom, atop a second carry bag system having a second carry bag and at least a second pair of upright support members extending therefrom, which comprises:

a) a handle having a generally elongated configuration; and b) a device for resiliently attaching said handle to a rear wall of said first carry bag in a manner to permit rotation of said handle between a first storage position so as to fit between the first pair of upright support members and a second interference position with the second pair of upright support members to thereby permit releasable attachment of the first carry bag system to the second pair of upright support members for transporting therewith, and when said handle is rotated to said first storage position, said handle is dimensionally capable of passage between the second pair of upright support members, whereby said first carry bag system is separable from the second pair of upright support members.

18. An article of luggage adapted for releasable attachment to a first carry bag system having a first carry bag and at least a pair of spaced apart upright support members, or to a wheeled luggage cart system having at least a pair of such spaced apart upright support members, which comprises:

a) a second carry bag; and b) a handle resiliently and rotatably attached to a rear wall portion of said second carry bag, said handle being dimensioned along at least a first direction for passage between the upright support members when the second carry bag is positioned adjacent the pair of upright support members and said handle is rotated to a first position generally parallel to the pair of upright support members, said handle being dimensioned along at least a second direction to interfere with and engage the upright support members when positioned thereagainst in at least one predetermined orientation generally transverse to the upright support members for transporting therewith, and when said handle is rotated to said first position, said handle is dimensionally capable of passage between the pair of upright support members, whereby said second carry bag is separable from the upright support members.

19. The article of luggage according to claim 18, wherein said handle comprises at least one-plate like member, and a pouch attached thereto for storage of articles therein.

20. The article of luggage according to claim 19, wherein said handle is elongated in shape.

21. A system for releasably attaching a carry bag to a wheeled luggage cart having a pair of spaced apart upright support members, which comprises:

a) a handle resiliently attached to a wall of said carry bag, said handle dimensioned along at least a first direction which permits said handle to pass through the pair of upright support members when in a first position generally parallel to the upright support members, said handle being dimensioned along at least a second direction to interfere with and engage the upright support members when positioned thereagainst when in at least a second attaching position generally transverse to the upright support members; and b) a device for resiliently and rotatably attaching said handle to said first carry bag in a manner to permit passage of said handle between the pair of upright support members when in said first position, and to facilitate resilient movement of said handle toward and away from said carry bag, and to permit rotation of said handle between said first and second positions, such that when said handle is rotated to said second position and retracted toward said carry bag, said handle engages the upright support members to thereby engageably and releasably attach said carry bag to the upright support members for transporting therewith, and when said handle is rotated to said first first position, said handle is dimensionally capable of passage between the pair of upright support members, whereby said carry bag is separable from the pair of upright support members.

22. The system according to claim 21, wherein said handle is attached to a rear wall of said carry bag.

23. A method for attaching a first carry bag system having a first carry bag and at least a first pair of upright support members extending therefrom, to a second carry bag system having a second carry bag and at least a second pair of spaced apart upright support members extending therefrom, wherein said first carry bag includes a handle rotatably attached thereto by resilient means in a manner which permits rotation thereof between a first storage position so as to fit between said first pair of upright support members, and a second attaching position which interferes with said second pair of upright support members for engagement therewith, comprising:

a) positioning said first carry bag atop said second carry bag;

b) gripping said handle and moving it away from said first carry bag so as to pass between said second pair of upright support members;

c) rotating said handle to said attaching position which interferes with said second pair of upright support members; and d) permitting said handle to be drawn toward said first carry bag by said resilient means until it engages said second pair of upright support members to thereby attach said first carry bag system to said second pair of upright support members for transporting therewith, and when said handle is rotated to said first storage position, said handle is dimensionally capable of passage between said second pair of upright support members, whereby said first carry bag system is separable from said second pair of upright support members.

24. The method according to claim 23, wherein said second attaching position of said handle which interferes with said second pair of upright support members is generally transverse to said support members.

25. A method for attaching a carry bag to a wheeled luggage cart having at least a pair of spaced apart upright support members, wherein said carry bag includes a handle rotatably attached thereto by resilient means in a manner which permits rotation thereof between a first position generally parallel to the pair of upright support members when said carry bag is positioned adjacent thereto, and a second attaching position generally transverse to the pair of upright support members for engagement therewith, comprising:

a) positioning said carry bag on said luggage cart;

b) gripping said handle and moving it away from said carry bag and between the pair of upright support members;

c) rotating said handle to said attaching position which interferes with the pair of upright support members; and d) permitting said handle to be drawn toward said carry bag by said resilient means until it engages said pair of upright support members to thereby attach said carry bag to the pair of upright support members for transporting therewith, and when said handle is rotated to said first position, said handle is dimensionally capable of passage between the pair of upright support members, whereby said carry bag is separable from the pair of upright support members.

* * * * *